US009972278B2

(12) United States Patent
Seo et al.

(10) Patent No.: US 9,972,278 B2
(45) Date of Patent: May 15, 2018

(54) LIGHT IRRADIATION DEVICE

(71) Applicant: HITACHI-LG DATA STORAGE, INC., Tokyo (JP)

(72) Inventors: Yoshiho Seo, Tokyo (JP); Satoshi Ouchi, Tokyo (JP); Hiromi Kusaka, Tokyo (JP)

(73) Assignee: HITACHI-LG DATA STORAGE, INC., Tokyo (JP)

( * ) Notice: Subject to any disclaimer, the term of this patent is extended or adjusted under 35 U.S.C. 154(b) by 0 days. days.

(21) Appl. No.: 15/204,024

(22) Filed: Jul. 7, 2016

(65) Prior Publication Data

US 2016/0314764 A1 Oct. 27, 2016

Related U.S. Application Data

(62) Division of application No. 14/184,737, filed on Feb. 20, 2014, now Pat. No. 9,412,338.

(30) Foreign Application Priority Data

Mar. 25, 2013 (JP) ..... 2013-061652

(51) Int. Cl.
*G09G 5/10* (2006.01)
*G09G 3/02* (2006.01)

(52) U.S. Cl.
CPC ..... *G09G 5/10* (2013.01); *G09G 3/025* (2013.01); *G09G 2310/0283* (2013.01);
(Continued)

(58) Field of Classification Search
CPC .. G09G 5/10; G09G 3/025; G09G 2310/0283; G09G 2310/0291;
(Continued)

(56) References Cited

U.S. PATENT DOCUMENTS 5,155,615 A * 10/1992 Tagawa ..... G09G 3/02 345/9
5,680,454 A 10/1997 Mead
(Continued)

FOREIGN PATENT DOCUMENTS

JP 4639973 B 12/2010

OTHER PUBLICATIONS

Communication pursuant to Article 94(3) EPC, dated Sep. 12, 2017, which issued during the prosecution of European Patent Application No. 14 000 573.7, which corresponds to the present application.

*Primary Examiner* — Nicholas Lee
*Assistant Examiner* — Ngan T Pham Lu
(74) *Attorney, Agent, or Firm* — Baker Botts L.L.P.

(57) ABSTRACT

A light irradiation device to display an image by light irradiation prevents easy perception of distortion occurring in the displayed image due to vibration of the device or movement of viewpoint. A random number is generated, and the refresh rate of the displayed image is distributed at random in correspondence with the random number. The light emission intensity is changed in correspondence with the refresh rate. When the number of lines is changed, the input video signal is subjected to scaling and a display is produced. The refresh rate is changed in correspondence with the frequency of the vibration detected with the vibration monitor.

4 Claims, 7 Drawing Sheets

(52) U.S. Cl.
CPC ..... *G09G 2310/0291* (2013.01); *G09G 2310/067* (2013.01); *G09G 2310/08* (2013.01); *G09G 2320/0233* (2013.01); *G09G 2320/0247* (2013.01); *G09G 2320/0261* (2013.01); *G09G 2320/064* (2013.01); *G09G 2320/0646* (2013.01); *G09G 2360/14* (2013.01)

(58) Field of Classification Search
CPC ..... G09G 2310/067; G09G 2310/08; G09G 2320/0233; G09G 2320/0261; G09G 2320/064; G09G 2320/0646
USPC ..... 345/691
See application file for complete search history.

(56) References Cited

U.S. PATENT DOCUMENTS

| | | | | |
|---|---|---|---|---|
| 2010/0321750 | A1* | 12/2010 | Burinskiy ..... | G09G 3/02 359/198.1 |
| 2011/0001888 | A1 | 1/2011 | Brown et al. | |

* cited by examiner

LIGHT IRRADIATION DEVICE

INCORPORATION BY REFERENCE

This application is a divisional application of U.S. patent application Ser. No. 14/184,737 filed on Feb. 20, 2014, which relates to and claims priority from Japanese Patent Application No. 2013-061652 filed on Mar. 25, 2013, the entire disclosure of all of which is incorporated herein by reference.

BACKGROUND OF THE INVENTION

Field of the Invention

The present invention relates to a light irradiation device to spatially sequentially scan a spot or a beam of light and irradiate an object with the scanned light, and further to display an image.

Description of the Related Art

The light irradiation device generates intensity-modulated light, deflects the light while reciprocating it with a mirror or the like in one direction, and further, deflects the light while reciprocating it with the mirror in a direction vertical to the above direction, to irradiate an object with the light and two-dimensionally scan the object. It is considered that the light irradiation device is applicable to an image display device (projector) disclosed in e.g. Japanese Patent Application No. 4639973 or a sensor to detect reflected light from an object irradiated with the light and measure the shape of the object or the distance from the object. Recently, downsizing and reduction of electric consumption are promoted regarding the light irradiation device, and applicability in various fields is expected.

SUMMARY OF THE INVENTION

In the above-described scan type light irradiation device, the light-irradiated position in the object timewisely changes. Regarding a position irradiated with light in some moment, displacement with respect to a predetermined reference position will be referred to as scan displacement.

On the other hand, when the above-described light irradiation device is applied to the image display device, the viewpoint of a viewer who is watching a displayed image moves. The movement of the viewpoint occurs due to vibration of the image at a display unit of the image display device or intentional movement of the viewpoint by the viewer. The displacement with respect to the predetermined reference position of the viewer's viewpoint including these cases will be referred to as image displacement.

On the retina of the viewer watching the displayed image, an image influenced by the above-described scan displacement and the image displacement is formed. Accordingly, image distortion to be described later perceptionally occurs. For example, when of an image having uniform brightness is displayed, an image with uneven brightness is visually detected.

Especially, when the difference between the refresh rate determined based on the frame frequency (e.g. 30 Hz) of the image and the cycle of the above-described image displacement is small, since the above-described image distortion slowly moves on the display screen, it attracts the viewer's notice.

The present invention has been made in view of the above-described problem, and has an object to provide a light irradiation device which prevents detection of distortion of displayed image.

To solve the above-described problem, the present invention provides a light irradiation device which displays a video image by light irradiation, including: a light source controller, supplied with a video signal based on the video image, that generates a luminance control signal based on the video signal; a light source driver that electric-power amplifies the luminance control signal supplied from the light source controller; a light source that generates light luminance-modulated based on the electric-power amplified luminance control signal supplied from the light source driver; a horizontal timing generator, supplied with the video signal based on the video image, that generates a horizontal pulse signal indicating horizontal synchronization timing for the video signal; a horizontal waveform generator that generates a rectangular horizontal waveform signal for scanning in a horizontal direction of the video image, based on the horizontal pulse signal generated with the horizontal timing generator; a random number generator that generates a random number; a vertical timing generator, supplied with the video signal based on the video image and the random number generated with the random number generator, that generates a vertical pulse signal, a frequency of which is varied at random based on the random number, by a predetermined or greater frequency width, with respect to a vertical synchronization frequency of the video signal; a vertical waveform generator that generates a rectangular vertical waveform signal for scanning in a vertical direction of the video image, based on the vertical pulse signal generated with the vertical timing generator; a deflection device driver, supplied with the horizontal waveform signal generated with the horizontal waveform generator and the vertical waveform signal generated with the vertical waveform generator, that electric-power amplifies and outputs the signals; and a deflection device, supplied with the light generated with the light source, that deflects the light in the horizontal direction and the vertical direction, based on the horizontal waveform signal and the vertical waveform signal outputted from the deflection device driver.

Further, the present invention provides a light irradiation device which displays a video image by light irradiation, including: a light source controller, supplied with a video signal based on the video image, that generates a luminance control signal based on the video signal; a light source driver that electric-power amplifies the luminance control signal supplied from the light source controller; a light source that generates light luminance-modulated based on the electric-power amplified luminance control signal supplied from the light source driver; a horizontal timing generator, supplied with the video signal based on the video image, that generates a horizontal pulse signal indicating horizontal synchronization timing for the video signal; a horizontal waveform generator that generates a rectangular horizontal waveform signal for scanning in a horizontal direction of the video image, based on the horizontal pulse signal generated with the horizontal timing generator; a vibration monitor that detects vibration of the light irradiation device and outputs an electric signal corresponding to the vibration; a vertical timing generator, supplied with the video signal based on the video image and the electric signal outputted from the vibration monitor, that generates a vertical pulse signal, a frequency of which is varied based on the electric signal outputted from the vibration monitor, with respect to the vertical synchronization frequency of the video signal; a vertical waveform generator that generates a rectangular vertical waveform signal for scanning in a vertical direction of the video image, based on the vertical pulse signal generated with the vertical timing generator; a deflection device driver, supplied with the horizontal waveform signal generated with the horizontal waveform generator and the vertical waveform signal generated with the vertical waveform generator, that electric-power amplifies and outputs the signals; and a deflection device, supplied with the light generated with the light source, that deflects the light in the horizontal direction and the vertical direction based on the horizontal waveform signal and the vertical waveform signal outputted from the deflection device driver.

According to the present invention, it is possible to provide a light irradiation device which prevents easy perception of the distortion of a display image.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE PREFERRED EMBODIMENTS

Hereinbelow, preferred embodiments of the present invention will be described in accordance with the accompanying drawings.

First Embodiment

Figure 1:
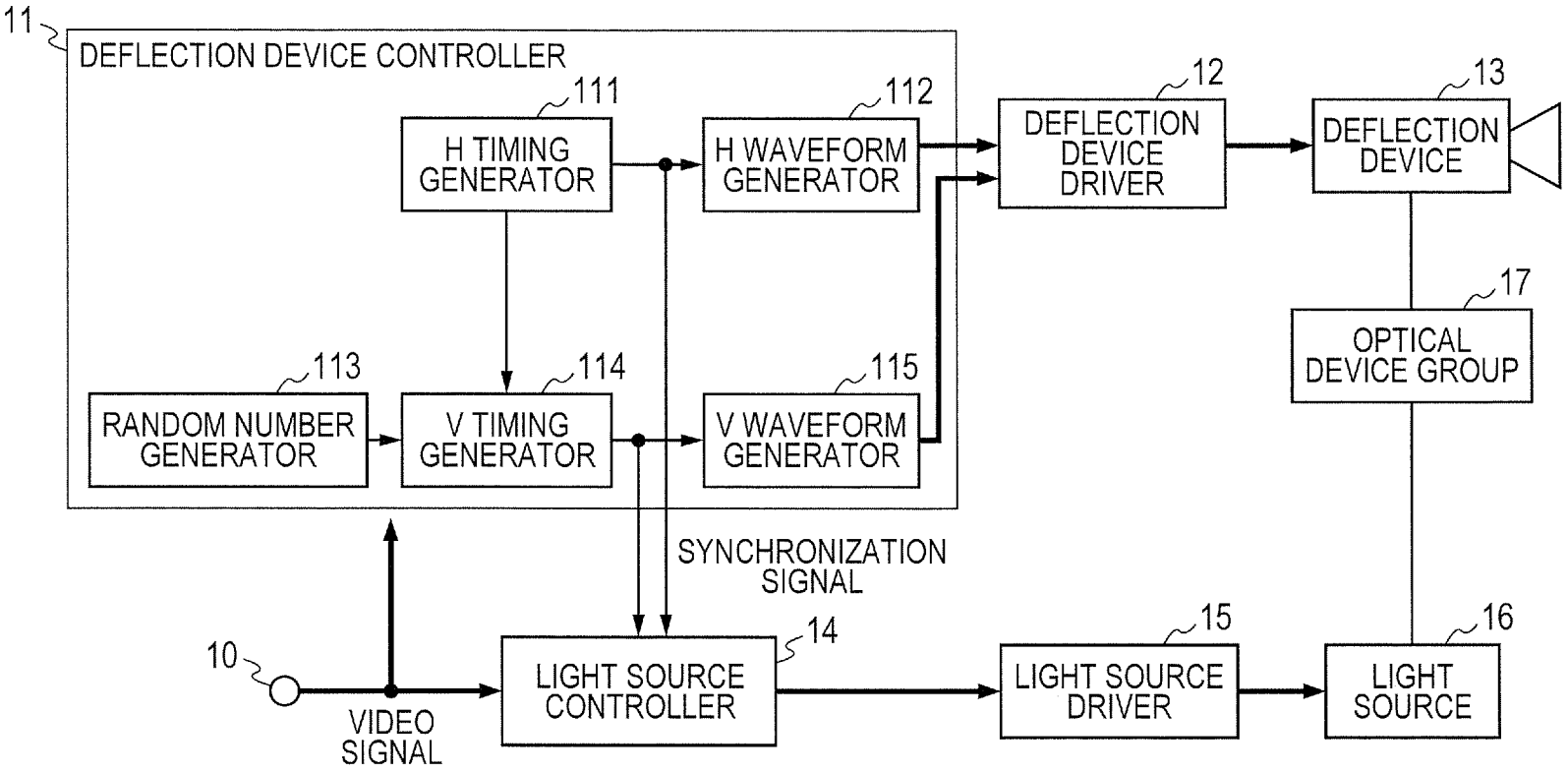
FIG. 1 is a block diagram of a light irradiation device in a first embodiment.

FIG. 1 is a block diagram of a light irradiation device 1 in a first embodiment. First, the overall explanation will be made with reference to FIG. 1, and thereafter, the characteristic features of the present embodiment will be described.

A video signal inputted from an input terminal 10 is a video signal for image display, and is supplied to a deflection device controller 11 and a light source controller 14.

The deflection device controller 11 generates a synchronization signal in a direction vertical to a horizontal direction of a scanned and displayed image, based on the supplied video signal, and supplies the signal to a deflection device driver 12.

The light source controller 14 generates a luminance control signal to control the luminance of a light source 16 to be described later, based on the luminance of the supplied video signal, and supplies the signal to a light source driver 15.

The deflection device controller 11 generates e.g. a horizontal pulse signal for an H (Horizontal) timing generator 111 to indicate horizontal synchronization timing of the image based on the supplied video signal, and supplies the signal to an H waveform generator 112.

The H waveform generator 112 generates e.g. a rectangular horizontal waveform signal for scanning in the horizontal direction based on the supplied horizontal pulse signal, and supplies the signal to the deflection device driver 12.

Further, the deflection device controller 11 generates e.g. a vertical pulse signal for a V (Vertical) timing generator 114 to indicate vertical synchronization timing of the image based on the supplied video signal, and supplies the signal to a V waveform generator 115.

The V waveform generator 115 generates e.g. a rectangular vertical waveform signal for scanning in the vertical direction based on the supplied vertical pulse signal, and supplies the signal to the deflection device driver 12.

Note that the V timing generator 114 is also supplied with a random number generated with a random number generator 113. Further, the horizontal pulse signal and the vertical pulse signal are also supplied to the light source controller 14. One of the features of the present embodiment is that the V timing generator 114 also refers to the supplied random number to generate the vertical pulse signal so as to control the operations of the light source controller 14 and the V waveform generator 115. However, this feature will be described later.

The deflection device driver 12 electric-power amplifies the horizontal waveform signal supplied from the H waveform generator 112 and the vertical waveform signal supplied from the V waveform generator 115, and supplies the signals to a deflection device 13.

The light source driver 15 electric-power amplifies the luminance control signal supplied from the light source controller 14, and supplies the signal to the light source 16.

The light source 16 generates light corresponding to the luminance of the video signal inputted into the input terminal 10 based on the supplied power-amplified luminance control signal.

The light generated with the light source 16 is supplied to an optical device group 17, and the optical device group 17 converts the supplied light from e.g. divergent light into collimated light, and supplies the light to the deflection device 13.

The deflection device 13 deflects the light, supplied from the optical device group 17, cyclically in the horizontal direction and the vertical direction, based on the horizontal waveform signal and the vertical waveform signal supplied from the deflection device driver 12.

With this operation, the light outputted from the deflection device 13 forms an image corresponding to the luminance of the video signal inputted into the input terminal 10 on e.g. a display unit provided outside the light irradiation device 1.

Note that in FIG. 1, only one route from the light source controller 14 to the light source 16 is shown; however, three routes corresponding to video image R (Red) signal, G (Green) signal and B (Blue) signal may be shown.

Next, the operation related to the random number generator 113 will be described.

In the present embodiment, the vertical pulse signal generated with the V timing generator 114 is generated not so as to be completely phase-synchronized with the vertical synchronization signal of the video signal supplied to the input terminal 10, but to vary based on the random number supplied from the random number generator 113, in consideration with a perceptible beat frequency width to be described later. The frequency of the vertical pulse signal varies within a range of e.g. ±3 to 20 Hz with the frequency of the vertical synchronization signal of the video signal supplied to the input terminal 10 as a center. The horizontal pulse signal generated with the V timing generator 114 may or may not be phase-synchronized with the variable vertical pulse signal.

The light source controller 14 sets the time axis of the luminance control signal to be generated based on the variable vertical pulse signal or the variable horizontal pulse signal.

With the above arrangement, it is possible to prevent easy perception of the distortion of the image displayed at the display unit.

The distortion of the image will be described in more detail.

Figure 2:
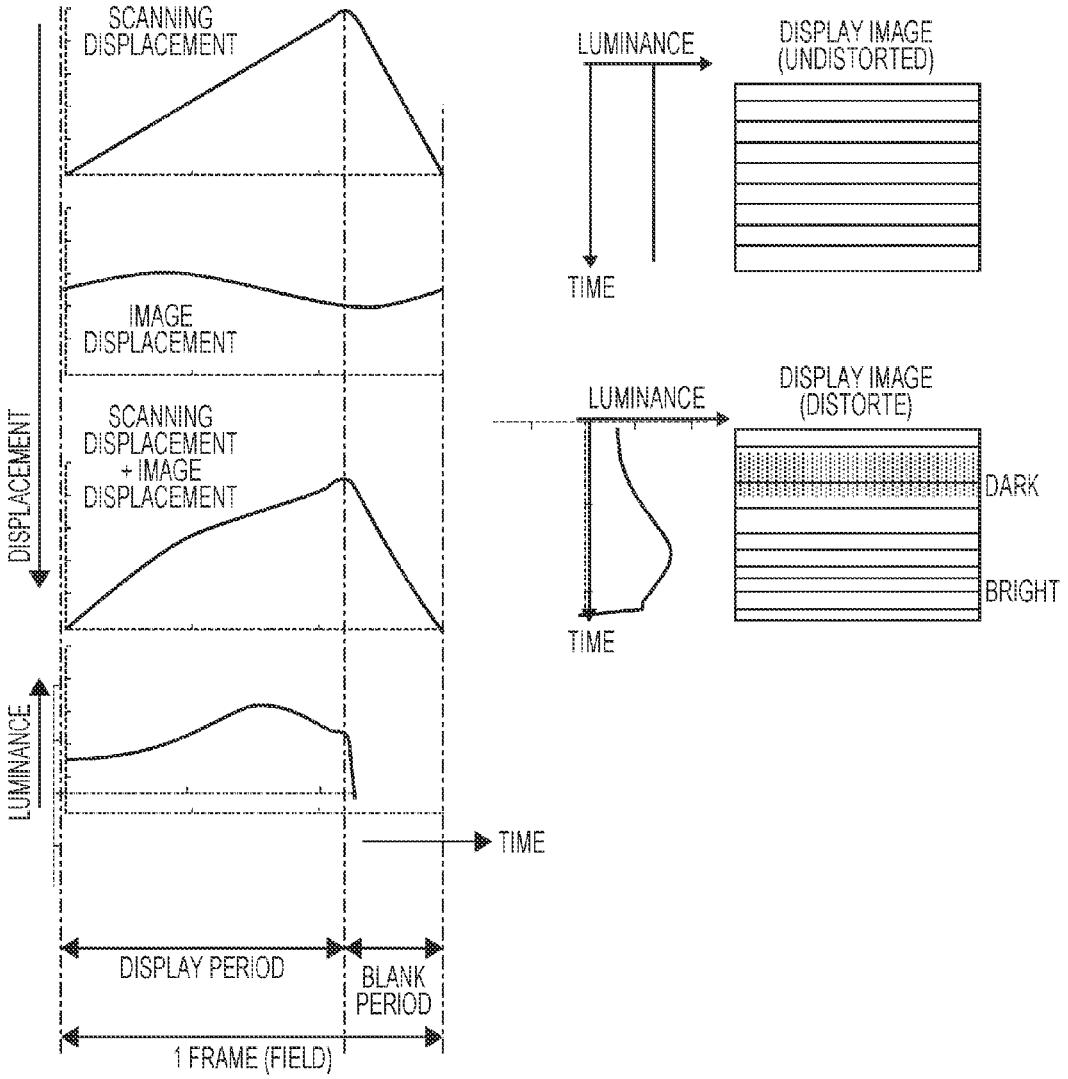
FIG. 2 is an explanatory diagram of image distortion due to displacement in a displayed image.

FIG. 2 is an explanatory diagram of image distortion due to displacement in a displayed image. In FIG. 2, the direction of the displacement is a positive direction from the upper side toward the lower side in the screen. As it is well known, the refresh rate of the displayed image depends on the cycle of the vertical synchronization pulse. Further, a 1-frame (or 1-field) video signal has an image display period and a vertical blank period of the image.

The above-described scan displacement occurs linearly from the upper side toward the lower side of the image during the image display period with respect to the time axis, and restores the initial position during the blank period.

FIG. 2 shows merely an example of the above-described image displacement since it occurs due to the vibration of the image at the display unit or the intentional movement of viewpoint by the viewer. In this example, with respect to the time axis, the image displacement occurs toward the lower side of the image screen during the first half of the 1 frame, and occurs toward the upper side of the image screen during the last half of the 1 frame.

An image corresponding to the sum of the scan displacement and the image displacement is perceived on the viewer's retina.

In this case, even when the luminance of the video signal inputted into the input terminal 10 is uniform in the entire image screen, it is not even on the viewer's retina, and an image with luminance distortion where the upper side of the image screen is dark while the lower side is bright is perceived.

Figure 3:
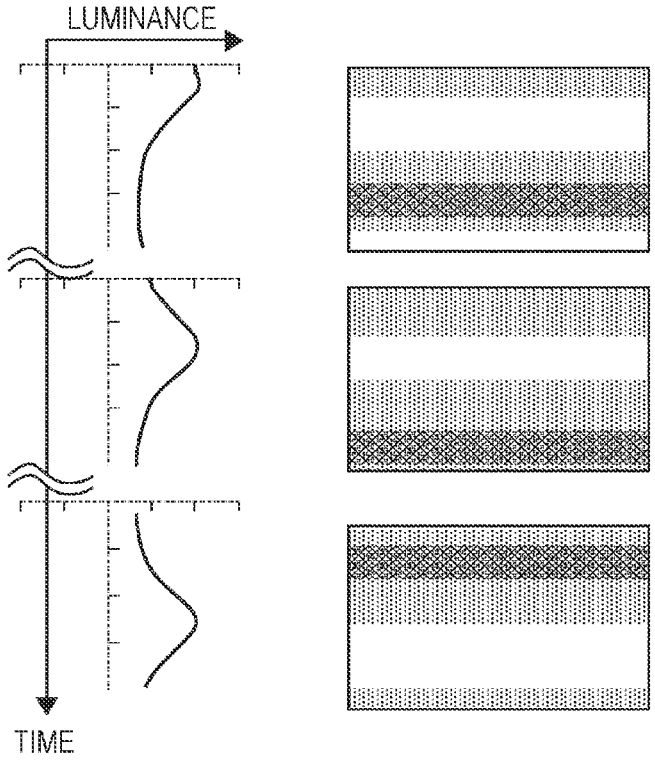
FIG. 3 is an explanatory diagram of movement of the image distortion in the displayed image.

FIG. 3 is an explanatory diagram of movement of the image distortion in the displayed image.

When the difference between the cycle of the scan displacement based on a predetermined refresh rate and the cycle of the image displacement due to e.g. eye movement is small, as the luminance distortion slowly moves in the vertical direction on the image screen as shown in FIG. 3. This attracts the viewer's attention.

Figure 4:
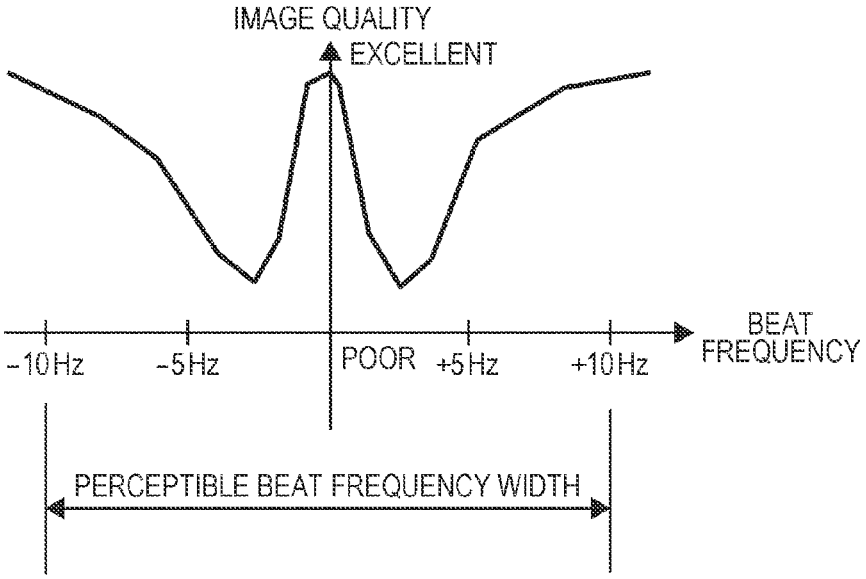
FIG. 4 illustrates the relation between a beat frequency related to the image distortion and image quality.

FIG. 4 illustrates the relation between a beat frequency related to the image distortion and image quality.

The above-described difference between the cycles will be referred to as a beat frequency below. FIG. 4 shows subjective image quality evaluation with respect to the beat frequency. As it is apparent from FIG. 4, when the distortion on the image screen stands still, i.e., the beat frequency is 0, the distortion on the image screen is not easily perceived. In accordance with shift of the beat frequency from 0, the distortion is easily perceived by its movement, and the image quality is degraded once. When the beat frequency becomes higher and the moving speed of the distortion is higher, the distortion is not easily perceived. The width of the beat frequency where the distortion is easily perceived will be referred below to as a perceptible beat frequency width. In the example of FIG. 4, the perceptible beat frequency width is ±10 Hz.

Note that the perceptible beat frequency width of ±10 Hz is an example, and actually, the perceptible beat frequency width changes by the influence of the image screen size or the like. Accordingly, it is desirable that the lower limit of the perceptible beat frequency width is ±3 Hz and the upper limit of the perceptible beat frequency width is ±20 Hz.

One of the characteristic features of the present embodiment is appropriately changing the refresh rate so as to prevent perception of the movement of the distortion in the image screen.

In FIG. 1, the V timing generator 114 also refers to the random number supplied from the random number generator 113 and generates the vertical synchronization pulse related to the refresh rate while varying the cycle. Accordingly, the refresh rate is distributed at random, and the frequency of the case where the beat frequency enters the range of the perceptible beat frequency width is reduced.

With this arrangement, it is possible to provide a light irradiation device which prevents easy perception of the distortion of the displayed image.

Second Embodiment

In the second embodiment, as a method for implementation of the first embodiment, in a 1-frame (field) image, the display period is fixed, while the blank period is varied at random.

Figure 5:
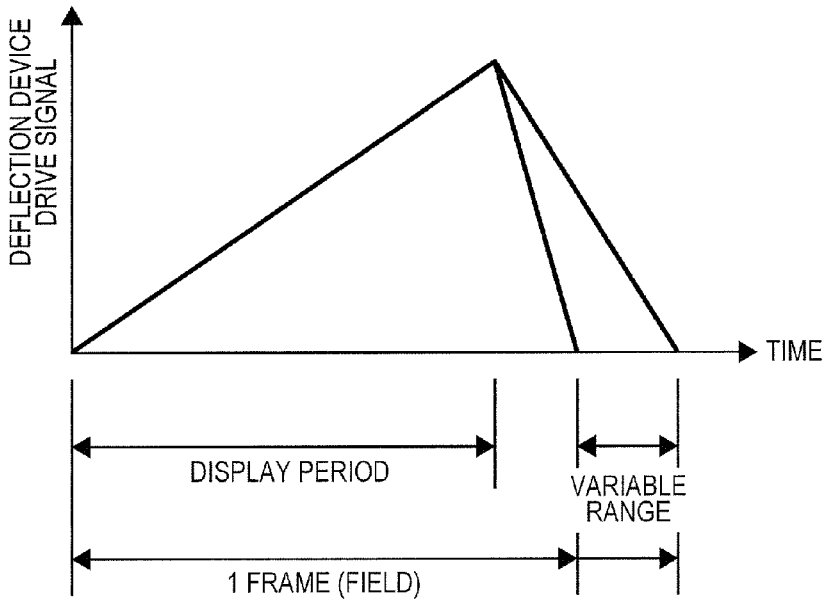
FIG. 5 illustrates a drive signal for the light irradiation device in a second embodiment.

FIG. 5 illustrates a drive signal for the light irradiation device 1 in the second embodiment, and particularly illustrates an example of the waveform of the vertical waveform signal supplied from the deflection device driver 12. As described above, the display period is fixed, while the blank period is varied at random in correspondence with the random number supplied from the random number generator 113. With this arrangement, the above-described refresh rate is distributed at random, and the frequency of the case where the beat frequency enters the range of the perceptible beat frequency width is reduced.

Figure 6:
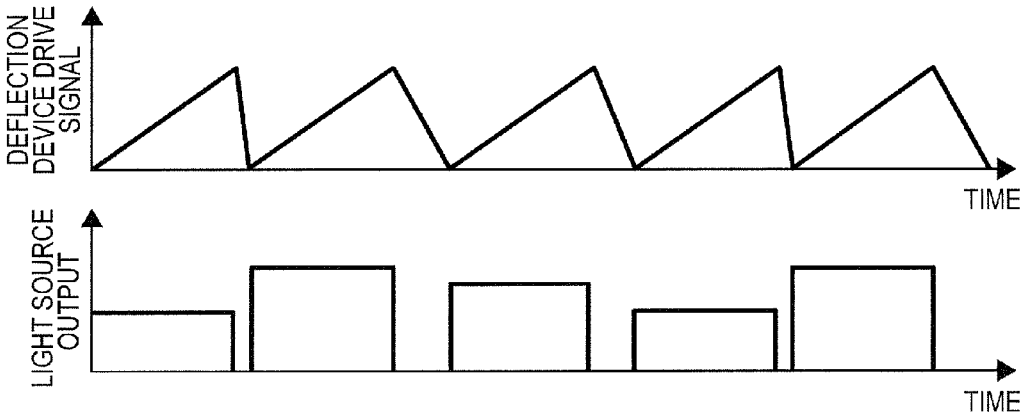
FIG. 6 illustrates the drive signal for the light irradiation device and light source output in the second embodiment.

FIG. 6 illustrates the drive signal for the light irradiation device 1 and light source output in the second embodiment. As described above, in the case where the blank period is varied at random, even when the display period of the image is fixed, since the light emission intensity per unit time varies timewisely, new luminance distortion might be detected. In this case, as shown in FIG. 6, it may be arranged such that the intensity of light emission with the light source 16 per 1 frame (field) is fixed timewisely. That is, when the 1-frame period is long and the refresh rate is low, the light emission intensity is increased. On the other hand, when the 1-frame period is short and the refresh rate is high, the light emission intensity is reduced.

With this arrangement, it is possible to provide a light irradiation device which prevents easy perception of the distortion of a displayed image, and further, reduces the factor of occurrence of new distortion.

Third Embodiment

In the third embodiment, as a method for implementation of the first embodiment, in a 1-frame (field) image, while a fixed ratio is maintained between the display period and the blank period, the length of the 1-frame (field) is varied at random.

Figure 7:
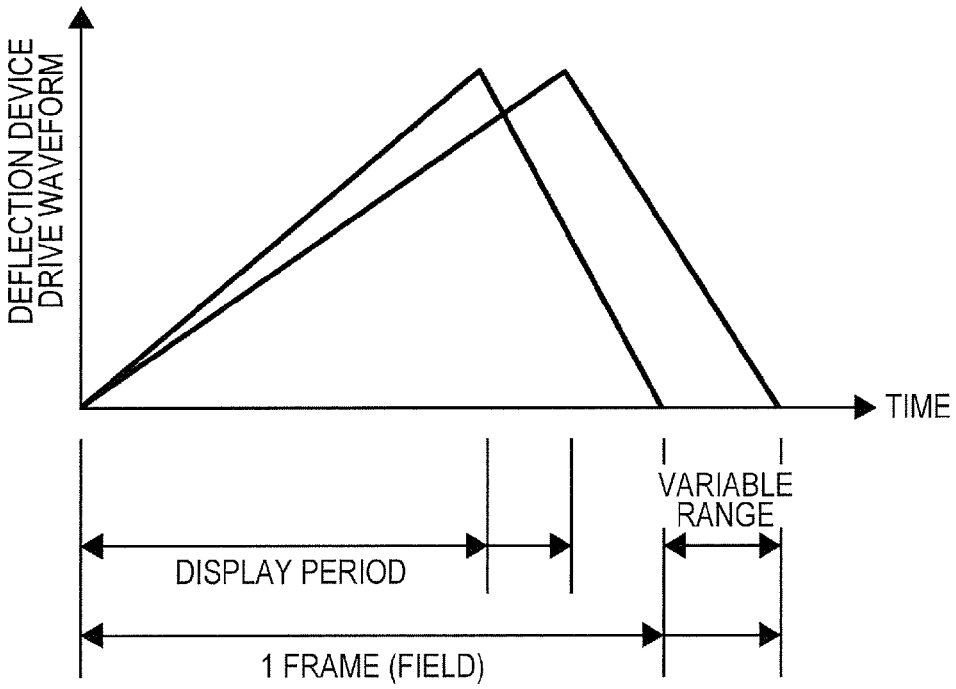
FIG. 7 illustrates the drive signal for the light irradiation device in a third embodiment.

FIG. 7 illustrates the drive signal for the light irradiation device 1 in the third embodiment, and particularly illustrates an example of the waveform of the vertical waveform signal supplied from the deflection device driver 12. As described above, the ratio between the display period and the blank period is fixed.

The number of image lines displayed by frame may vary in some cases.

Figure 8:
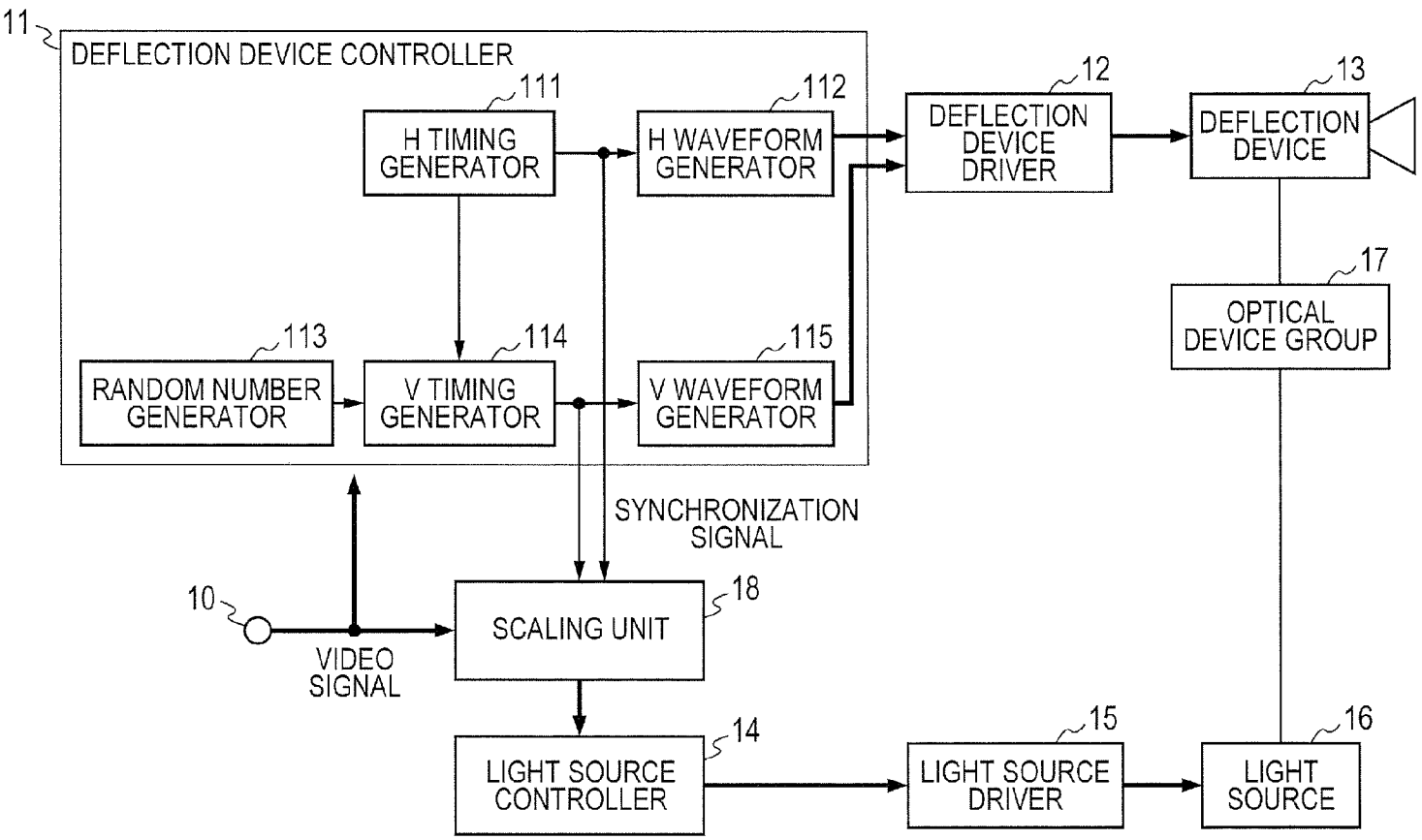
FIG. 8 is a block diagram of the light irradiation device in the third embodiment.

FIG. 8 is a block diagram of the light irradiation device 1 in the third embodiment. Unlike the example shown in FIG. 1, the video signal supplied from the input terminal 10 is supplied to the light source controller 14 via a scaling unit 18 in correspondence with the varying number of lines. The scaling unit 18 is supplied with the vertical pulse signal and the horizontal pulse signal from the deflection device controller 11.

The scaling unit 18 performs scaling on the video signal supplied from the input terminal 10. That is, based on the vertical pulse signal and the horizontal pulse signal, the scaling unit 18 detects the number of lines in the processed image frame, performs signal calculation between the lines, generates a video signal corresponding to the current number of lines, and supplies the signal to the light source controller 14.

With this arrangement, it is possible to provide a light irradiation device which generates a video signal corresponding to the number of lines of a displayed image, and reduces the factor of occurrence of a new problem.

Fourth Embodiment

In the above-described first to third embodiments, the V timing generator 114 generates a vertical pulse signal corresponding to the refresh rate of a displayed image based on the random number supplied from the random number generator 113, in consideration of the perceptible beat frequency width.

In the fourth embodiment, the V timing generator 114, in place of the random number generator 113, generates the vertical pulse based on information on the frequency of vibration and phase supplied from the vibration monitor 116.

As described above, the image displacement occurs due to the vibration of the image at the display unit or the intentional movement of viewpoint by the viewer. Regarding the vibration of the image at the display unit, it may be arranged such that the vibration of e.g. the light irradiation device 1 is monitored so as to prevent easy perception of the distortion of the displayed image.

When the vibration is within the range of the above-described perceptible beat frequency width with respect to the refresh rate of the video signal supplied to the input terminal 10, i.e., the vertical synchronization frequency, the V timing generator 114 generates the vertical pulse signal such that the refresh rate of the displayed image corresponds with the vibration frequency. With this arrangement, the beat frequency shown in FIG. 4 is approximately 0 Hz, and it is possible to prevent easy perception of the distortion of displayed image.

Figure 9:
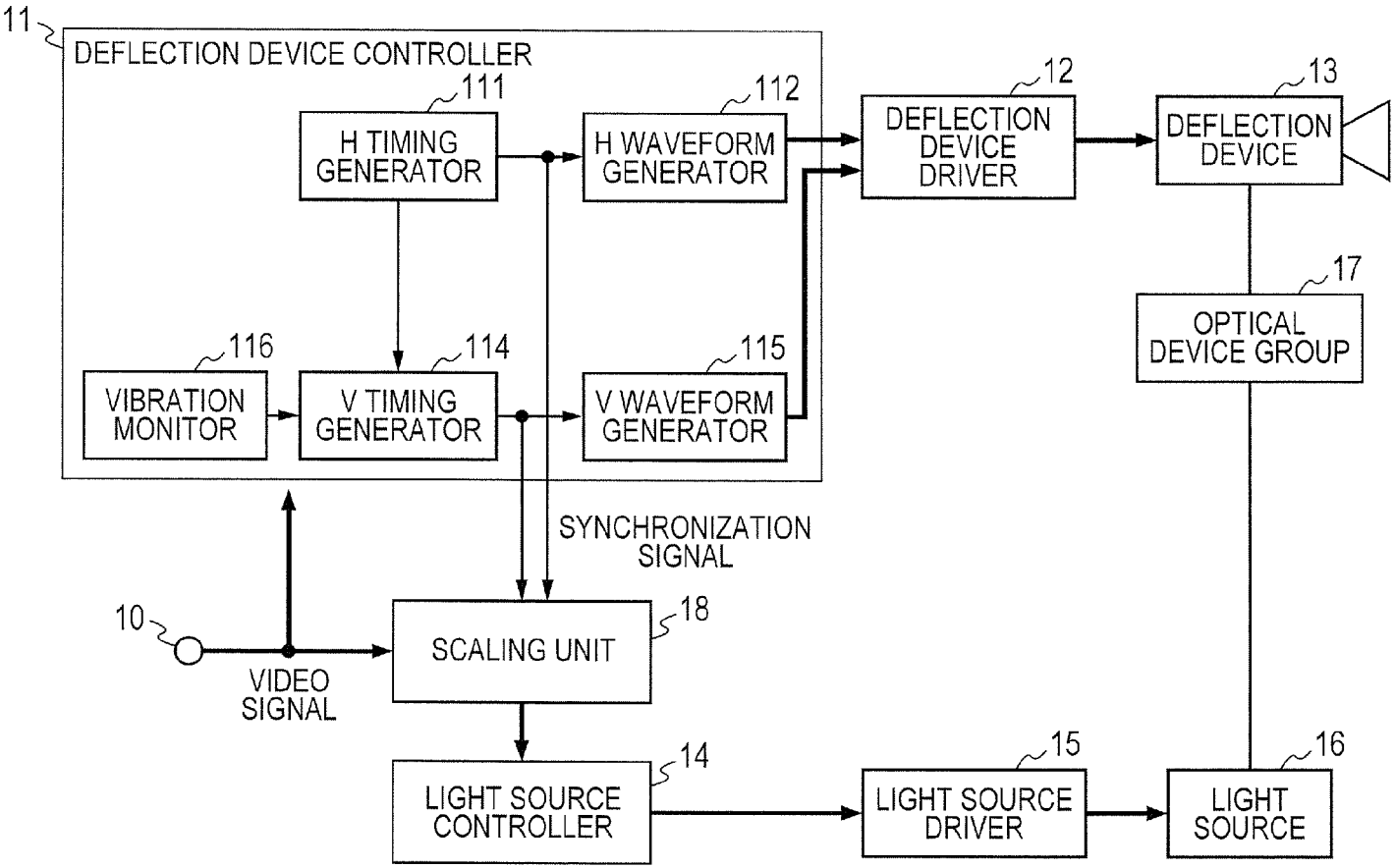
FIG. 9 is a block diagram of the light irradiation device in a fourth embodiment.

FIG. 9 is a block diagram of the light irradiation device 1 in the fourth embodiment. Unlike the examples in FIG. 1 and FIG. 8, the block diagram of FIG. 9 has a vibration monitor 116 in place of the random number generator 113. The V timing generator 114 generates the vertical pulse signal based on the information on the vibration detected with the vibration monitor 116. Note that as in the case of the example shown in FIG. 8, the block diagram of FIG. 9 has the scaling unit 18; however, the fourth embodiment is applicable to a configuration similar to that shown in FIG. 1 without scaling unit 18.

As a method for detecting the vibration with the vibration monitor 116, an electromagnetic method, an optical method or a method using a distortion sensor may be employed. In the electromagnetic method, a coil is placed inside a magnetic field generated with a permanent magnet such that the coil generates an electric signal corresponding to the vibration in accordance with relative movement between the coil and the permanent magnet. In the optical method, a photo sensor detects light generated with an oppositely positioned LED (Light Emitting Diode), and the photo sensor generates an electric signal corresponding to the vibration in accordance with relative movement between the photo sensor and the LED.

As the distortion sensor, a metal foil distortion sensor which generates an electric signal corresponding to the variation of electric resistance of the metal foil by vibration, or a semiconductor distortion sensor which generates an electric signal corresponding to the variation piezoresistance of the semiconductor may be employed. Note that a so-called acceleration sensor is applicable as the vibration monitor 116.

Since the vibration in the displayed image reflects the vibration of the deflection device 13, the deflection device 13 may have the above-described constituent element to generate an electric signal.

As a factor of image displacement, in addition to the vibration of the light irradiation device 1, the intentional movement of viewpoint by the viewer is given. It may be arranged such that, for detection of the movement of viewpoint, the light irradiation device 1 has an image pickup device (not shown). The V timing generator 114 generates the vertical pulse signal based on the result of addition of the movement of viewpoint detected with the image pickup device to the above-described vibration, in consideration of phase. With this arrangement, the beat frequency shown in FIG. 4 is approximately 0 Hz, and it is possible to prevent easy perception of distortion of a displayed image.

Fifth Embodiment

In the fourth embodiment, when the vibration detected with the vibration monitor 116 is within the range of the above-described perceptible beat frequency width with respect to the refresh rate of the video signal supplied to the input terminal 10 i.e. the vertical synchronization frequency, the V timing generator 114 generates the vertical pulse signal such that the refresh rate of the displayed image corresponds to the above-described vibration frequency.

However, the object of the embodiment is attained by other methods than that shown in the fourth embodiment. An example of such methods will be shown in the fifth embodiment.

For example, the frequency of the vertical pulse signal generated with the V timing generator 114 may be changed in correspondence with the range of the vibration frequency in the perceptible beat frequency width with respect to the refresh rate of the video signal supplied to the input terminal 10 i.e. the vertical synchronization frequency.

In this case, when the frequency of the vibration detected with the vibration monitor 116 is within the half of the perceptible beat frequency width shown in FIG. 4 with respect to the refresh rate of the video signal supplied to the input terminal 10 i.e. the vertical synchronization frequency, that is, ±5 Hz, the V timing generator 114 operates as in the case of the fourth embodiment. That is, the V timing generator 114 generates the vertical pulse signal such that the refresh rate of the displayed image corresponds to the vibration frequency.

On the other hand, when the vibration frequency is ±5 Hz to ±10 Hz in the example shown in FIG. 4, the V timing generator 114 generates the vertical pulse signal such that the absolute value of the refresh rate of the displayed image is different from the vertical synchronization frequency of the video signal supplied to the input terminal 10 by 10 Hz or more. As explained in FIG. 4, since the distortion of the displayed image is not easily perceived outside the perceptible beat frequency width, the object is attained.

With this arrangement, it is possible to provide a light irradiation device which prevents easy perception of the distortion of a displayed image without varying extremely the vertical cycle of the displayed image from the vertical cycle of the supplied video signal.

The above-described embodiments merely show examples and different embodiments to attain the object of the present invention may be considered within the scope of the present invention.

While the several embodiments have been described in accordance with the present invention, it should be understood that the disclosed embodiments are susceptible of changes and modifications without departing from the scope of the present invention. Therefore, the details shown and described herein cover all such changes and modifications that fall within the ambit of the appended claims.

What is claimed is:

1. A light irradiation device which displays a video image by light irradiation, comprising:

a light source controller, supplied with a video signal based on the video image, that generates a luminance control signal based on the video signal;

a light source driver that electric-power amplifies the luminance control signal supplied from the light source controller;

a light source that generates light luminance-modulated based on the electric-power amplified luminance control signal supplied from the light source driver;

a horizontal timing generator, supplied with the video signal based on the video image, that generates a horizontal pulse signal indicating horizontal synchronization timing for the video signal;

a horizontal waveform generator that generates a rectangular horizontal waveform signal for scanning in a horizontal direction of the video image, based on the horizontal pulse signal generated with the horizontal timing generator;

a vibration monitor that detects vibration of the entire light irradiation device and outputs an electric signal corresponding to the vibration wherein the electric signal indicates a frequency of the vibration of the entire light irradiation device;

a vertical timing generator, supplied with the video signal based on the video image and the electric signal outputted from the vibration monitor, that generates a vertical pulse signal having a frequency which is varied based on the electric signal outputted from the vibration monitor with respect to the vertical synchronization frequency of the video signal such that the refresh rate of the video image corresponds with the frequency of the vibration frequency of the entire light irradiation device indicated by the electric signal;

a vertical waveform generator that generates a rectangular vertical waveform signal for scanning in a vertical direction of the video image, based on the vertical pulse signal generated with the vertical timing generator;

a deflection device driver, supplied with the horizontal waveform signal generated with the horizontal waveform generator and the vertical waveform signal generated with the vertical waveform generator, that electric-power amplifies and outputs the signals; and a deflection device, supplied with the light generated with the light source, that deflects the light in the horizontal direction and the vertical direction based on the horizontal waveform signal and the vertical waveform signal outputted from the deflection device driver.

2. The light irradiation device according to claim 1, wherein, regarding a perceptible beat frequency width in which a beat occurring in a displayed image is perceived due to a difference between the vertical synchronization frequency of the video signal supplied to the light irradiation device and a frequency of the vertical pulse signal generated with the vertical timing generator, when a frequency of the electric signal outputted from the vibration monitor is within the perceptible beat frequency width and is closer to the vertical synchronization frequency of the video signal supplied to the light irradiation device than a predetermined frequency, the vertical timing generator sets the frequency of the generated vertical pulse signal to the frequency of the electric signal outputted from the vibration monitor, and when the frequency of the electric signal outputted from the vibration monitor is farther from the vertical synchronization frequency of the video signal supplied to the light irradiation device than the predetermined frequency, the vertical timing generator sets the frequency of the generated the vertical pulse signal to a frequency outside the perceptible beat frequency width.

3. The light irradiation device according to claim 1, wherein a vibration detection unit in the vibration monitor is included in the deflection device.

4. The light irradiation device according to claim 1, wherein the vibration monitor has a semiconductor distortion sensor.

* * * * *